US005310006A

United States Patent [19]

Freitas et al.

[11] Patent Number: 5,310,006

[45] Date of Patent: May 10, 1994

[54] SATELLITE TREE MODULE AND FLOW LINE STRUCTURE FOR INTERCONNECTION OF A SATELLITE WELL TO A SUBSEA PRODUCTION SYSTEM

[75] Inventors: André Luiz V. Freitas; Cezar A. S. Paulo; José Eduardo M. Silva, all of Rio de Janeiro, Brazil

[73] Assignee: Petróleo Brasileiro S.A. -Petrobrás, Rio de Janeiro, Brazil

[21] Appl. No.: 925,631

[22] Filed: Aug. 7, 1992

[30] Foreign Application Priority Data

Aug. 9, 1991 [BR] Brazil ..... 9103429

[51] Int. Cl.[5] ..... E21B 23/04; E21B 33/038; E21B 43/01

[52] U.S. Cl. ..... 166/339; 166/344; 166/349; 405/195.1; 405/224

[58] Field of Search ..... 166/339, 351, 357, 344, 166/343, 350

[56] References Cited

U.S. PATENT DOCUMENTS

| | | | |
|---|---|---|---|
| 4,378,848 | 4/1983 | Milberger | 166/351 |
| 4,705,114 | 11/1987 | Schroeder et al. | 166/357 |
| 4,848,475 | 7/1989 | Dean et al. | 166/339 X |
| 5,005,650 | 4/1991 | Hopper | 166/339 |
| 5,025,865 | 6/1991 | Caldwell et al. | 166/339 X |
| 5,040,607 | 8/1991 | Cordeiro et al. | 166/339 X |
| 5,192,167 | 3/1993 | da Silva et al. | 166/339 X |

*Primary Examiner*—Ramon S. Britts
*Assistant Examiner*—Frank S. Tsay
*Attorney, Agent, or Firm*—Sughrue, Mion, Zinn, Macpeak & Seas

[57] ABSTRACT

A satellite tree module (STM) (10) for controlling flow between a satellite flow and a subsea production system includes at the bottom of the STM a connector (12) of an internal-latch, hydraulically operated type. A lower structure (14) consists of a central ring and projecting arms terminating in guide funnels. An upper structure (18) supports a reentry pole (20) integrated to the STM assembly (10) via an orientation key, a reentry mandrel (22) and a cap (24) for protection of the external profile of the reentry mandrel (22) and its receptacles. A flow system is arranged above the lower structure (14) and inside the upper structure (18). The flow system consists of a set of pipes and valves through which production-/injection, production testing and lift-gas fluids flow. A flow line terminal (26) and a control system responsible for the activation of the STM (10) components during the operational phase are amounted to one of the upper and lower structures.

15 Claims, 6 Drawing Sheets

SATELLITE TREE MODULE AND FLOW LINE STRUCTURE FOR INTERCONNECTION OF A SATELLITE WELL TO A SUBSEA PRODUCTION SYSTEM

FIELD OF THE INVENTION

This invention refers to a satellite tree module (STM) which effects flow control between a satellite well and a manifold of a subsea petroleum production system, as well as to a flow line structure (FLS) utilized for the interconnection of said satellite well to said petroleum production system. State of the Art The subsea production systems for petroleum originating from wells located at large depths were developed for subsea completion, since such option is the most feasible, both technically and economically.

Among the subsea production systems is a template-manifold which includes, among other components, a template structure, a manifold, wet Christmas trees and satellite trees module. The subsea production systems known to date have, as their major characteristic, the provision, in the manifold, of active elements, such as chokes, maneuver valves and control modules. This leads to both an increased number of recoverable modules and a reduced system reliability.

OBJECT OF THE INVENTION

With the purpose of reducing the number of recoverable modules arranged in the manifold of a subsea production system, thus improving the reliability of the system, this invention is directed to satellite tree module providing flexibility to the connection of the flow lines to the manifold, presents valves and chokes oriented towards one single face and presents also a multiplexed control with hydraulic lines directly connected to the satellite wet Christmas tree.

Different from satellite tree modules known to date, the satellite tree module of this invention permits the advantegeous possibility of coupling the module selectively to one of plural mouths of a template-manifold, including an already installed wellhead; In addition, the satellite module presents flexibility for the connection of the flow lines to the manifold, while allowing alterations at the surface, in case of any difficulty.

This invention refers also to a structure of flow lines for interconnection of a satellite well to a subsea petroleum production system.

DESCRIPTION OF THE INVENTION

This invention refers to a satellite tree module (STM) for flow control between a satellite well and a manifold of a subsea petroleum production system of the type described in Brazilian application for privilege number PI 9005123 owned by a common assignee.

The satellite tree module (STM) of this invention includes:

in a lower part, an internal-latch type, hydraulically activated; connector;

a lower structure consisting of a central ring, and arms with guide-funnels;

an upper structure;

a reentry pole integrated to the STM via an orientation key;

a cap for protection of the external profile of said reentry mandrel and its receptacles;

a flow system consisting of a set of pipes and valves through which flow the fluids of the production/injection, production testing and gas-lift lines, with the system arranged over said lower structure and inside said upper structure;

a flow line terminal; and a control system responsible for the activation of the functions of both the STM and a satellite Christmas tree associated with the STM during an operation phase.

DETAILED DESCRIPTION OF THE INVENTION

More specifically, the STM of this invention includes: at the bottom, a connector of internal-latch type, hydraulically activated; a lower structure consisting of a central ring and arms with guide-funnels; an upper structure consisting of tubular columns and beams; a reentry pole integrated to the STM assembly via an orientation key; a reentry mandrel allowing for STM installation with a wet Christmas tree (WCT) running tool; a cap for protection of said mandrel and its receptacles; a flow system, arranged above the lower structure and below the reentry mandrel. The system consisting of a set of pipes and valves through which flow the fluids of the production/injection, production testing and gas-lift lines. The system includes loops for the production, production testing and annulus lines, valves for the production and production testing lines, and one valve for the annulus line, chokes, one for the production/water-injection line and another choke installed in the annulus line, a vertical connection block and cross-pieces for handling the production and, production testing and annulus lines. A flow line terminal arranged on the lower structure to allow for the connection of the flow lines and of the hydraulic control lines between the STM and the manifold of the subsea production system; and a control system, which is the assembly responsible for the activation of the STM functions during the operation phase, and consists of a base for module formed of an electrohydraulic multiplexed control, hydraulic connector, pressure transducers, small-diameter valves and cables with electrical connectors.

This invention refers also to a flow line structure (FLS) for interconnection of a satellite well to a subsea production system, consisting of a connector for FLS locking to the drilling mouth of the template in the subsea production system with a mandrel with internal profile for STM locking. A main structure consists of beams with one extremity fastened to the connector and the other cantilevered. A cradle structure is compatible with the pulling and connection tools and is located at the cantilevered extremity of the main structure. A FLS terminal is located on the cradle structure. A vertical connection block is provided for the FLS flow lines. An electrohydraulic vertical connector and rigid pipes provide a flow conduction between the FLS terminal and the vertical connection block.

These objectives, characteristics and advantages of this invention shall become now more apparent through the following detailed description when taken together with the drawings.

DETAILED DESCRIPTION OF THE FIGURES

Figure 1:
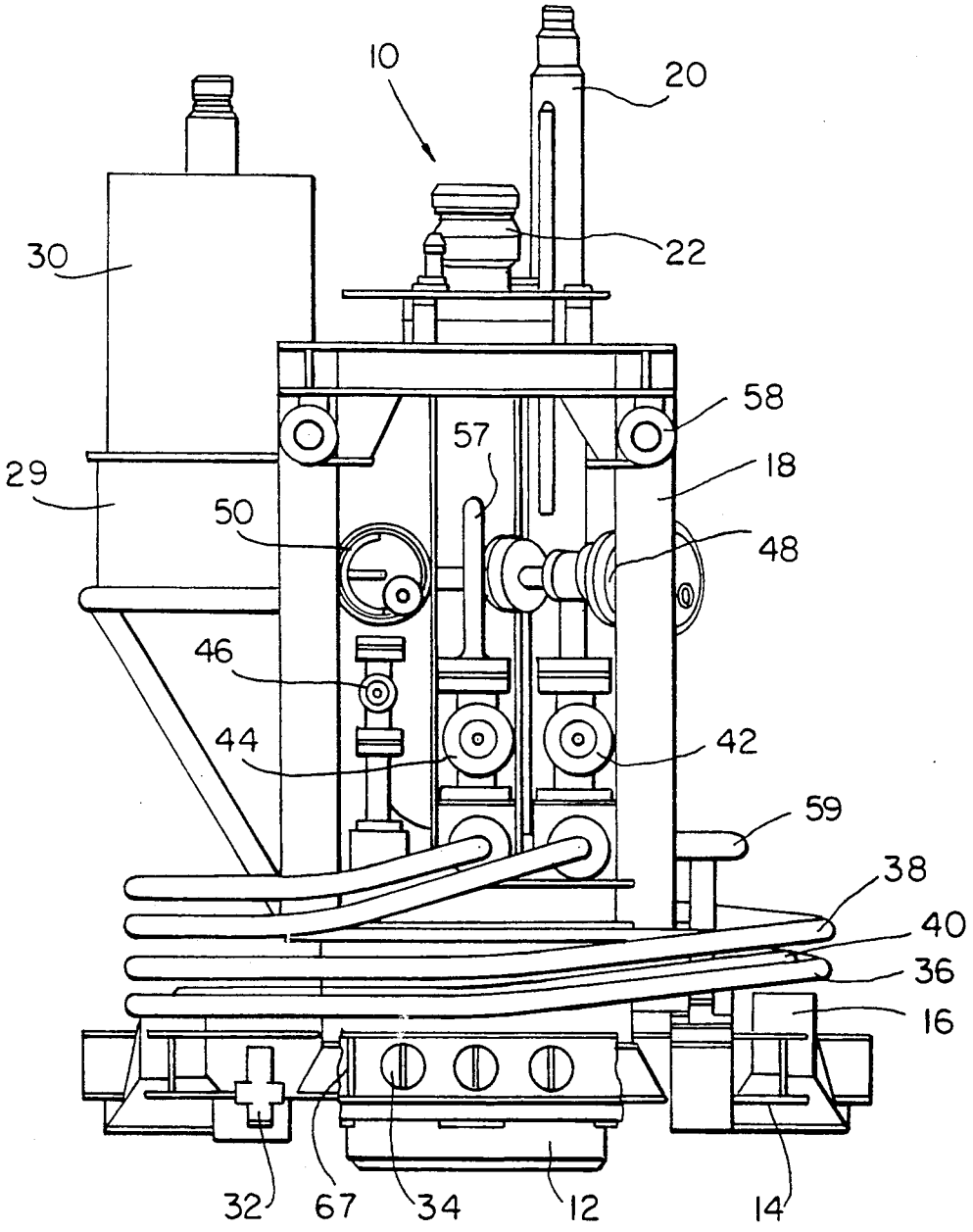
FIG. 1 is a front view of a satellite tree module (STM) forming a preferred embodiment of the invention.
Figure 2:
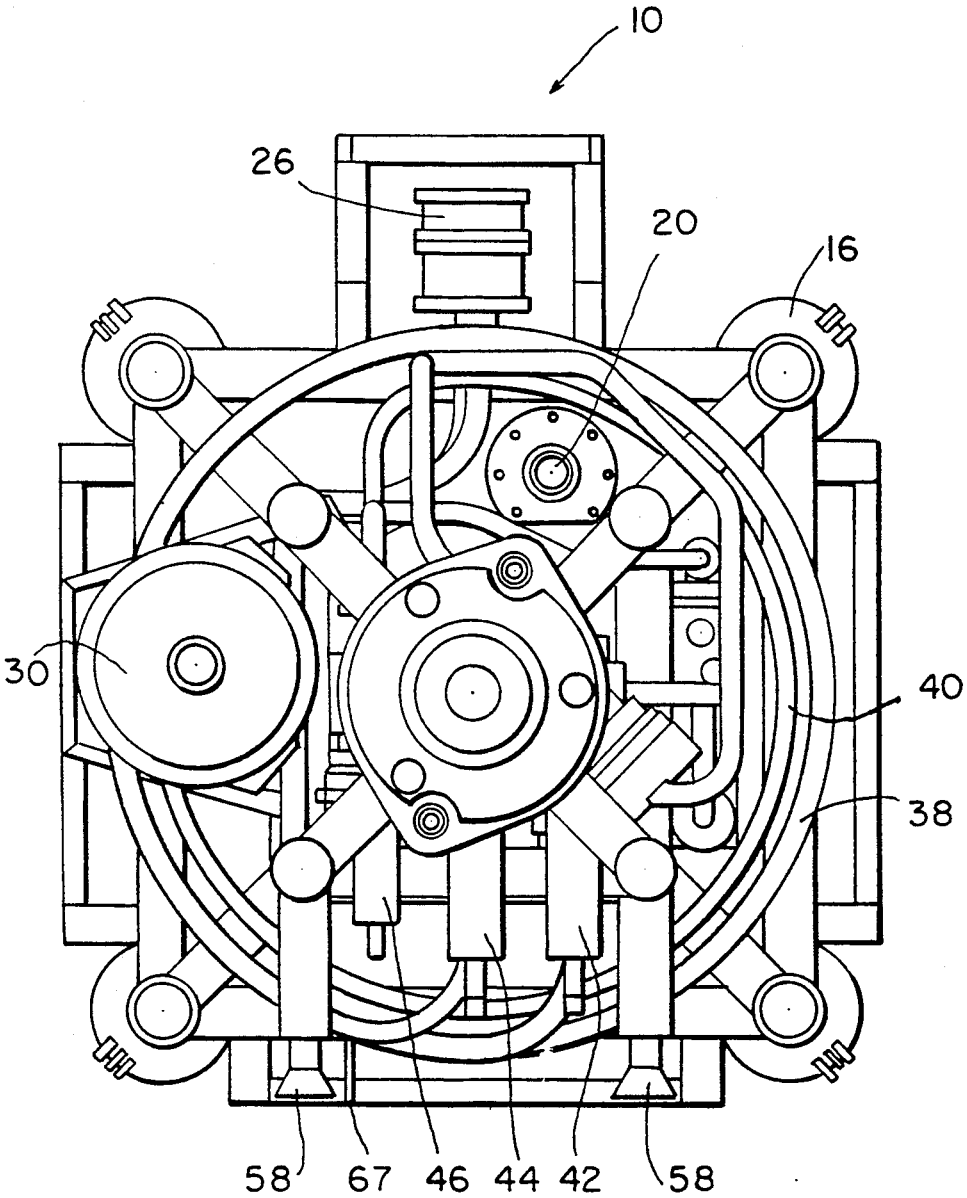
FIG. 2 is a top plan view of the STM.
Figure 3:
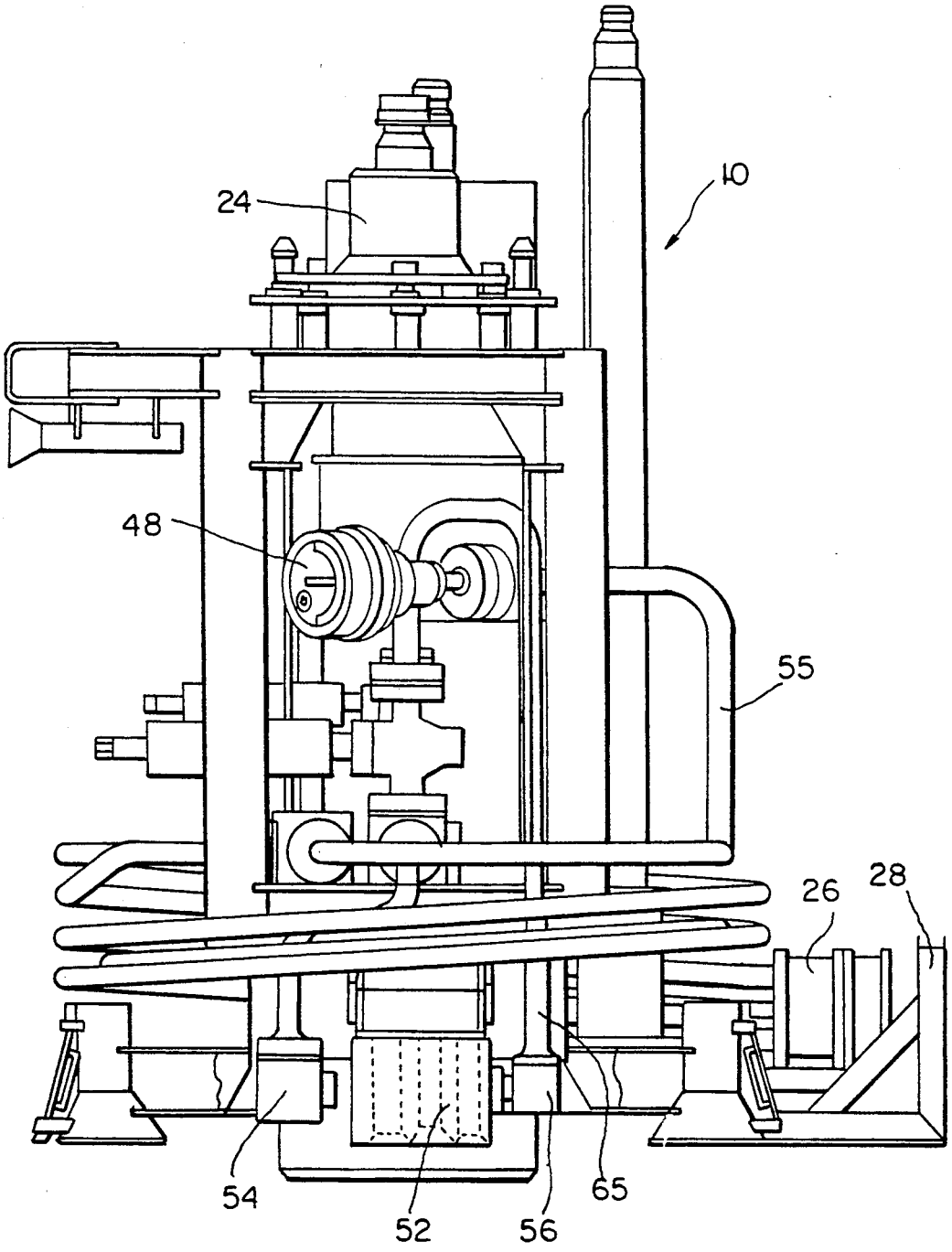
FIG. 3 is a side elevational view of the STM.

This invention refers to a satellite tree module (STM), referred to in general by the numerical reference 10 in FIGS. 1 through 3. It consists at the bottom of an internal-latch type, hydraulically activated connector 12 a lower structure 14 consisting of a central ring and arms with guide-funnels 16; and an upper structure 18. A reentry pole 20 is integrated to the assembly of the STM 10 via an orientation key. A reentry mandrel 22 and a cap 24, FIG. 3, for protection of the external profile of said reentry mandrel 22 and its receptacles are part of a flow system arranged above the lower structure 14 and inside the upper structure 18. The flow system consists of a set of pipes and valves, through which flow the fluids of the production/injection, production testing and gas-lift lines. A flow line terminal 26 and a control system are responsible for the activation of the functions assigned to the STM 10 during the operation phase.

More specifically, this invention pertains to a satellite tree module (STM), referred to in general by the numerical reference 10 in FIGS. 1 through 3, including at a bottom thereof, an internal-latch type, hydraulically activated connector 12, with visual position indicator (locked/unlocked) easily seen from the rig TV or ROV/RCV, equipped with secondary mechanism unlocking for extension up to the top of the STM for purposes of activation by a tool to be run with a drill string. A lower structure 14 consists of a central ring and arms supporting guide-funnels 16 provided with portholes for the passage of the guide-cables. A upper structure 18 consists of tubular columns and beams. A reentry pole 20 is integrated to the assembly of the STM with an orientation key. A reentry mandrel 22 allows the STM installation with the WCT running tool, as is prepared at the top, to receive an STM running tool. A cap is provided to the STM, a tool for secondary unlocking of the connector and a handling tool, said reentry mandrel 22 is assembled on the upper structure 18 of the STM and presenting receptacles for connection of the hydraulic lines of the STM installation tool (connector locking and unlocking and testing of the gaskets in the vertical connection block) and of the STM cap. A cap 24 FIG. 3, provides protection of the external profile of the reentry mandrel 22 and its receptacles. A flow system is arranged above the lower structure 14 and below the reentry mandrel 22. The flow system consists of a set of pipes and valves, through which flow the fluids of the production/water-injection, production testing and gas-lift lines flow line terminal 26 is incorporated in the STM arrangement. The terminal is designed to effect the connection of the production, production testing and annulus flow lines and the hydraulic control lines between the STM and the manifold. The terminal consists basically of the terminal itself, a device for retraction of pipe loops and locking of the terminal, and a protection structure 28. The protection structure 28 has the function of preventing terminal damages during the transportation and handling operations, and must be removed prior to running the STM. A control system constitutes the assembly responsible for the activation of the STM functions during the phase of operation with base 29, FIG. 6 electrohydraulic multiplexed control module 30. Hydraulic control lines, electrohydraulic connector 32; pressure transducers installed directly at the crosspieces of the production and annulus lines. Small-diameter valves 34 effect isolation of the testing lines from the seals of the vertical connection block 52 and for the line of the backup system of the control 32. Cables with electric connectors conduct a signal of the downhole pressure and temperature transmitter DPTT) and of the pressure transducers to the base 29 of the control module 30.

The flow system includes two pipe loops 36, 38 of the production and production testing lines, and one loop 40 of the annulus line, with one loop extremity flanged an the other bevelled for purpose of welding at the terminal of connection 26 to the manifold. The loops 36, 38, 40 have a degree of flexibility compatible with the course required by the connection system. Two valves 42, 44 are provided for the production and production testing lines, respectively and one valve 46 for the annulus line. The valves 42, 44, 46 are gate type valves with normally closed hydraulic activators, usually closed; Two chokes 48, 50, are provided one for the production/water-injection line and the other installed on the annulus line (for gas-lift control) hydraulically adjustable. The choke 48 has inlet and outlet flanges equidistant in relation to the choke centerlines of the body, to permit its installation in an inverted position to work in both production and injection mode. A vertical connection block 52 for three through holes for lodging in its orifices, the sealing gaskets for the sealing pins and having channels for the sealing testing lines of these seals and being attached to a cradle fastened to the lower structure 14. A pipe 55 connects the choke 48 to the production loop 36. A pipe 57 connects the production valve 42 to the production testing valve 44. A pipe 59 connects the production valve 42 to the vertical connection block 52; and a pipe 65 connects the choke 50 to the vertical connection block 52. Also blocks (crosspieces) 54 are provided for the production and production testing line loops and a block (crosspiece) 56 is provided for the annulus line. The blocks 54, 56 fix one end of the lines to the lower structure 14.

It must be pointed out that the lower structure 14 is designed to fasten the connector 12 to the upper structure 18, and fastens the vertical connection block 51 and the vertical electrohydraulic connector 32 and guide the STM during its installation. The upper structure 18 receives, at the top, the reentry mandrel 22, and fastens to the lower structure 14. The upper structure 18 serves as a base for the control module 30. The reentry pole 20 functions to guide and orient the tool for STM/STM-cap installation, the tool for secondary unlocking of the connector 12 and the tool for installation of the control module 30.

The STM 10 and the STM cap 24 may preferably be installed with the same WCT running tool. The cap 24, shown in FIG. 1, acts as the structure for anchoring of the ROV 58, which makes it easy to activate the override the mechanisms of the hydraulic activators of the flow valves, and the structure for anchoring of the ROV 67 for activation of the valves for testing and backup of the control system.

The valves of the STM 10 have their activators oriented towards an external face of the template-manifold which is equipped with an interface for secondary ROV operation. The STM is susceptible of conversion from production to water injection through the mere inversion of the choke 48.

Figure 4:
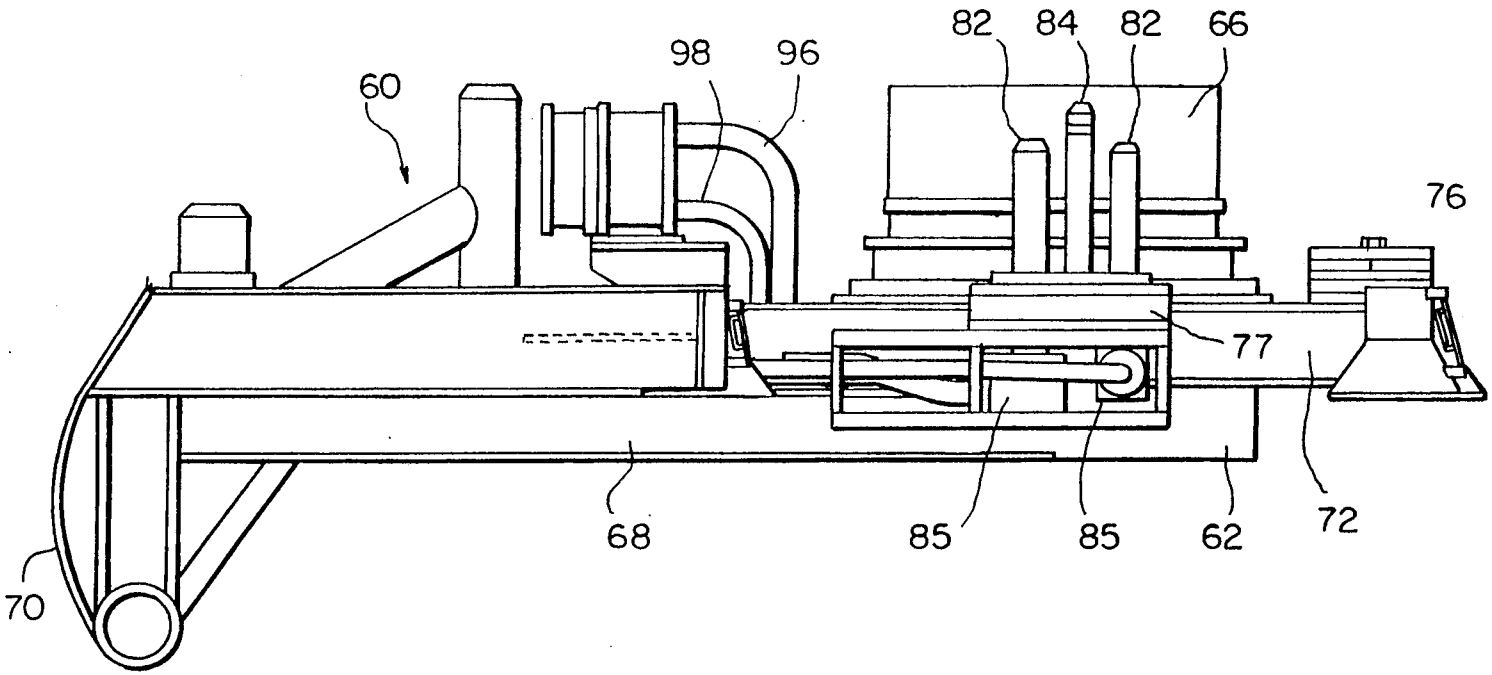
FIG. 4 is a lateral view of a flow line structure (FLS) thereof.
Figure 5:
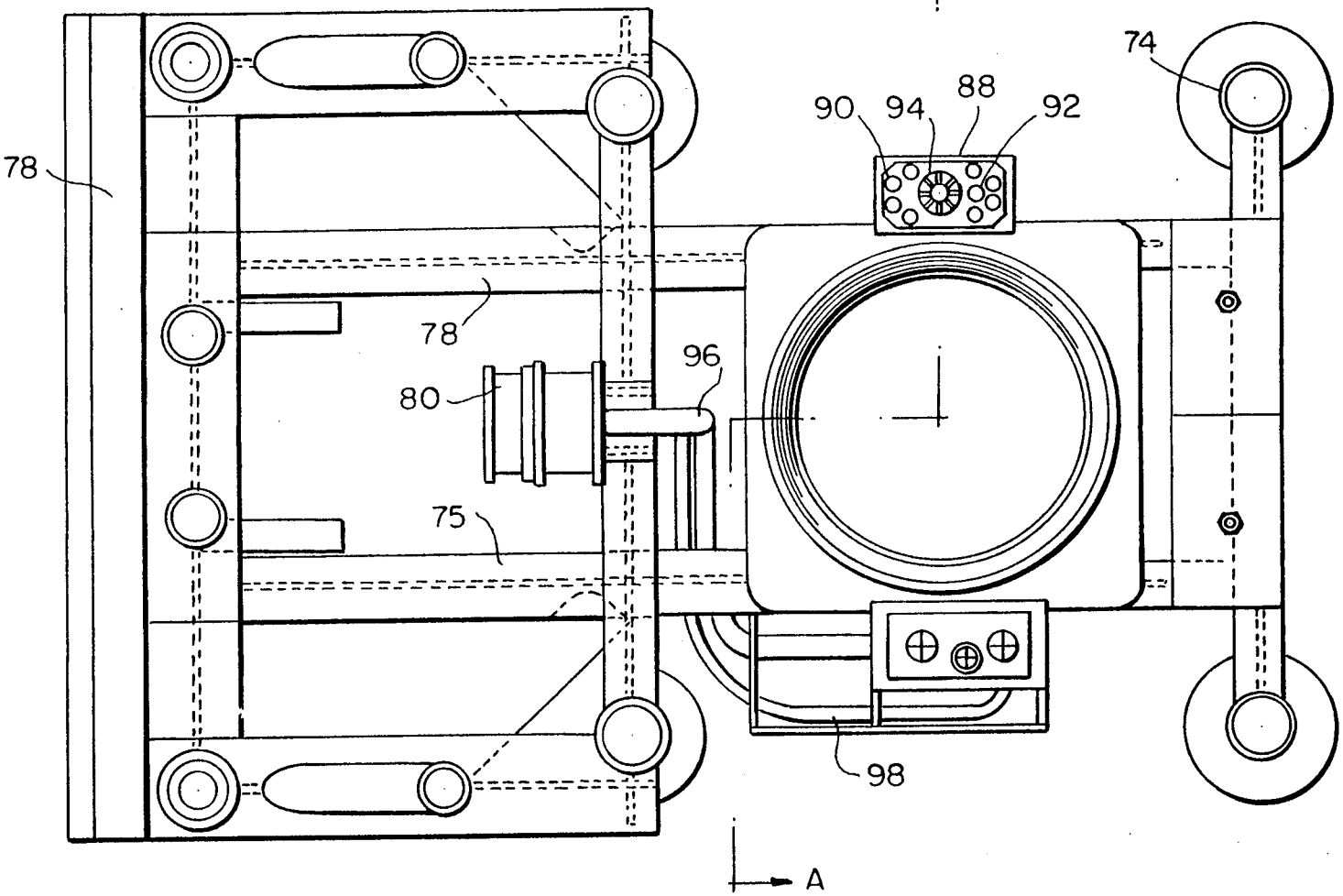
FIG. 5 is to top plan view of the FLS.
Figure 6:
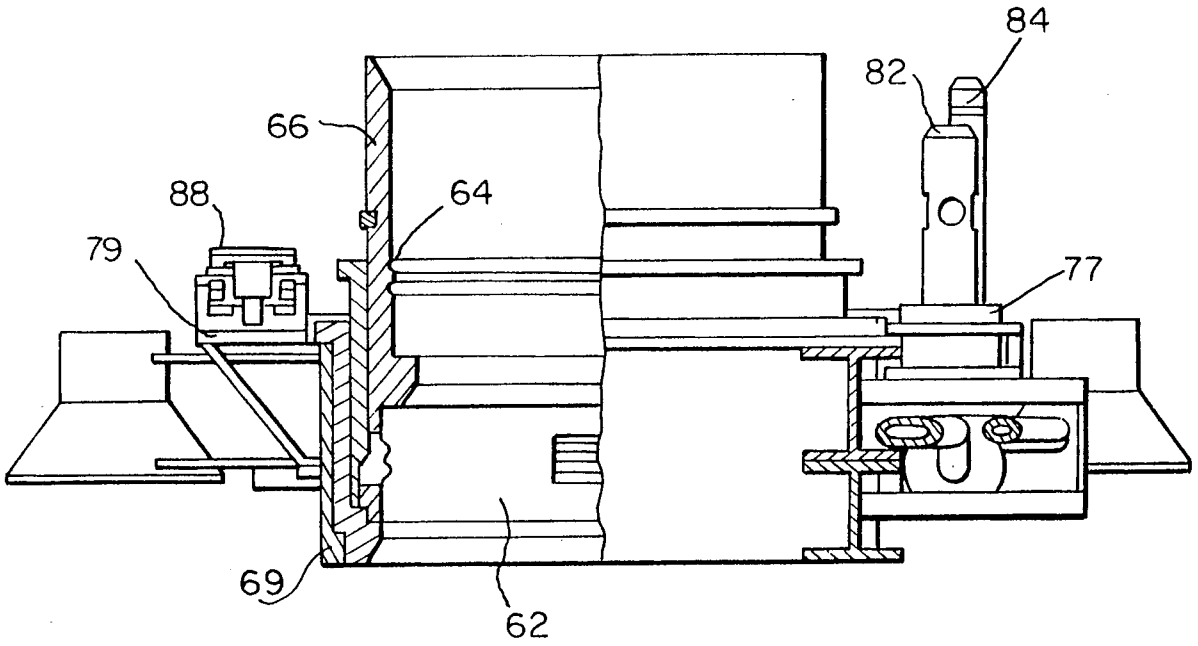
FIG. 6 is a view partially in section thereof taken along AA of FIG. 5.

In addition, as it may be seen in FIGS. 4 through 6, a flow line structure (FLS) indicated generally at 60 is provided for interconnection of a satellite well to a subsea production system, externally locked to the time-plate guide-pipe. The FLS 60 includes a mechanical connector 62 activated by a specific tool to be locked to the external profile of the template guide-pipe, said mechanical connector 62 being provided at the top with a mandrel 66 with internal profile 64, FIG. 6, for locking to the STM A main structure 68 consisting of beams, has a central ring 69, FIG. 6, for attachment to the connector 62. Beams 75, FIG. 5 mount a cradle structure 78, and supports 77, 79 for attachment of the vertical connection block of the flow lines and of the electro-hydraulic plate and, respectively. A wall 70 to helps the approximation of the terminal of the lines originating from the satellite wet Christmas tree WCT during the pull. Arms 72 support guide-funnels 74 and counter-weights 76 to balance the FLS during its running. The cradle structure 78 compatible with the pull and connection tools, is located at the cantilevered extremity of the main structure 68. A hub 80, FIG. 5, of the FLS, located on the cradle structure 78, functions to establish the connection of the lines originating from the satellite WCT with the FLS. A vertical connection block of the FLS flow lines, is an assembly formed by a block attached to the main structure 68 and further consisting of stabs 82 capable of compensating for minor deviations between same and the STM receptacles, an alignment pin 84 and blocks 85 (crosspieces) for attachment of the rigid piping of the flow lines, originating from the FLS. A plate 88 of hydraulic and electric connectors is installed on the main structure 68, containing eight hydraulic line connectors 90 with a fast-coupling check valve, an electric connector 92 for signal transmission between FLS and STM and a central guide 94 with dogs or a spring ring for unlocking the STM plate from the FLS plate, and production piping 95 and annulus piping 98 for flow conduction between the FLS terminal 80 and the FLS vertical connection block.

The FLS 60 is installed with drill string through a moon-pool of a completion rig.

We claim:

1. A satellite tree module (STM) having a top and a bottom and comprising:

a lower structure, an upper structure;

an internal-latch type, hydraulically activated connector mounted to said lower structure and located at the bottom of the STM;

said lower structure comprising a central ring, said connector (12) passing through said ring and being coupled to a vertical connection block (52), and said lower structure further comprising a plurality of arms extending outwardly of said lower structure and terminating in guide-funnels (16);

a flow system contained inside said upper structure (18) at a level above said lower structure (14) and comprising pipes for production and production testing and valves coupled to said pipes for controlling the flow of production/injection, production testing and lift-gas fluids therethrough;

a control system mounted to one of said lower structure and said upper structure for controlling activation and deactivation of components of the satellite tree module during the operational phase;

said satellite tree module also including a re-entry pole (20) integrated to an assembly of said satellite tree module (10) by means of an orientation key; a re-entry mandrel (22) and a cap (24) mounted to said upper structure, said cap (24) protecting the external profile of said re-entry mandrel (22), and said satellite tree module further comprising a flow line terminal (26) connected to said set of pipes.

2. A satellite tree module, according to claim 1, wherein said connector (12) comprises a secondary mechanical unlocking mechanism with extension up to the top of said STM (10) and being mounted to one of said lower structure and said upper structure for activation by means of a tool run with a drill string.

3. A satellite tree module, according to claim 1, wherein said re-entry mandrel (22) comprises receptacles for connection of hydraulic lines of a STM (10) installation tool, of the STM cap (24) and of tools for the secondary connector (12) for unlocking and handling the STM (10).

4. A satellite tree module, according to claim 1, wherein said flow system further includes:

loops (36, 38) within said pipes for production and production testing and a loop (40) for an annulus line;

valves (42, 44) for a production line and production testing line, respectively, and a valve (46) for the annulus line;

chokes (48, 50) for the production/water injection line and for the annulus line; and wherein said pipes compromise a first pipe connecting said choke (48) to said production line (36), a second pipe (57) connecting said production valve (42) to said production testing valve (44), a third pipe (59) connecting said production valve (42) to said vertical connection block (52), and a fourth pipe (65) connecting said annulus choke (50) to said vertical connection block; and said STM further comprises crosspieces (54) for said production and production testing lines and a crosspiece (56) for the annulus line.

5. A satellite tree module, according to claim 4, wherein said valves (42, 44, 46) comprise normally closed gate valves having hydraulic activators.

6. A satellite tree module, according to claim 4, wherein said chokes (48, 50) are hydraulically adjustable, and one of said chokes (48) has inlet and outlet flanges equidistant in relation to a centerline of a choke body whereby, such that said one choke (48) may be installed in inverted position thereby working in both production and injection modes of the STM.

7. A satellite tree module, according to claim 1, wherein said flow line terminal (26) includes a device for loop retraction and terminal locking, and said STM (10) further comprises a protection structure (28) at the bottom about said flow line terminal (26).

8. A satellite tree module, according to claim 4, wherein said valves (34, 42, 44, 46) have said activators oriented towards an external face of a template-manifold of said STM and said activators are equipped with an interface for remote control vehicle (ROV) operation.

9. A satellite tree module, according to claim 4, wherein inversion of said choke (48) converts said STM (10) from production to water injection.

10. A satellite tree module, according to claim 1, further comprising a satellite wet Christmas tree (WCT) and wherein, said STM comprises an electrohydraulic multiplexed control and direct hydraulic outlets towards said satellite WCT.

11. A flow line structure (FLS) for interconnection of a satellite well to a subsea production system, said flow line structure (60) comprising means for externally locking said FLS to a guide-pipe of a template of a satellite tree module (STM) (10), a mechanical connector (62) with an internal profile (64) for locking to an upper part of said STM (10), a main structure (68) consisting of beams, a cradle structure (78) cantilever mounted to an extremity of said main structure (68), a terminal (80) located on said cradle structure (78) connecting lines originating from a satellite wet Christmas tree (WCT) to said FLS (60), a vertical flow line connection block, a plate (88) of hydraulic and electrical connectors, said plate (88) being fixably attached to said main structure (68), and production (96) and annulus (98) piping connecting said terminal (80) to said vertical connection block.

12. A flow line structure for interconnection of a satellite well to a subsea production system, according to claim 11, wherein said mechanical connector (62) is connected to a mandrel (66) having an internal profile for locking and unlocking to said STM

13. A flow line structure for interconnection of a satellite well to a subsea production system, according to claim 11, wherein said main structure (68) comprises a central ring (69) attached to said connector (62), beams (75) attached to said cradle structure (78), supports (77, 79) fixing the vertical flow line connection block to said FLS and said supporting said electrohydraulic plate (88), a wall (70), arms (72) having guide-funnels (74) and counterweights (76).

14. A flow line structure for interconnection of a satellite well to a subsea production system, according to claim 11, wherein said vertical flow line connection block includes an assembly formed by a block mounted to said main structure (68), stabs (82), alignment pin (84) and cross pieces (85) for attachment of rigid piping of said flow lines originating from said terminal (80).

15. A flow line structure for interconnection of a satellite well to a subsea production system, according to claim 11, wherein said electrohydraulic plate (88) includes a plurality of hydraulic line connectors (90) having a fast-coupling check valve, an electrical connector (92) for effecting signal transmission between said FLS (60) and said STM (10), and a central guide (94) with one of dogs and a spring ring for locking and unlocking said plate (88) of said STM (10) to said plate of said FLS (60).

* * * * *